US006443860B1

(12) United States Patent
Byrne et al.

(10) Patent No.: US 6,443,860 B1
(45) Date of Patent: Sep. 3, 2002

(54) KNOB FOR A METAL BALL BAT

(75) Inventors: Robert M. Byrne, Lima; Kurt F. Hafeken, Sr., Elida, both of OH (US)

(73) Assignee: American Trim, LLC, Lima, OH (US)

( * ) Notice: Subject to any disclaimer, the term of this patent is extended or adjusted under 35 U.S.C. 154(b) by 0 days.

(21) Appl. No.: 09/637,235

(22) Filed: Aug. 11, 2000

(51) Int. Cl.[7] ..... A63B 59/06
(52) U.S. Cl. ..... 473/568; 473/566
(58) Field of Search ..... 473/564–568, 473/457, 519, 520

(56) References Cited

U.S. PATENT DOCUMENTS

| | | | | | |
|---|---|---|---|---|---|
| 1,026,990 | A | * | 5/1912 | Matson | 473/519 |
| 1,499,128 | A | | 6/1924 | Shroyer, Jr. | |
| 1,611,858 | A | | 12/1926 | Middlekauff | |
| 2,379,006 | A | * | 6/1945 | Johnson | 473/519 |
| 3,779,551 | A | * | 12/1973 | Wilson | 473/566 |
| 4,000,895 | A | | 1/1977 | Scott, Jr. et al. | 273/72 A |
| 4,131,981 | A | | 1/1979 | Scott et al. | 29/505 |
| 4,177,989 | A | | 12/1979 | Easton et al. | 273/72 A |
| 4,768,785 | A | * | 9/1988 | Patterson | 473/457 |
| 5,380,003 | A | | 1/1995 | Lanctot | 273/72 R |
| 5,409,214 | A | | 4/1995 | Cook | 273/72 R |
| 5,421,572 | A | | 6/1995 | MacKay, Jr. | 273/72 A |
| 5,511,777 | A | | 4/1996 | McNeely | 273/72 A |
| 5,593,158 | A | * | 1/1997 | Filice et al. | 473/520 |
| 5,785,614 | A | | 7/1998 | MacKay, Jr. | 473/566 |
| 5,785,617 | A | | 7/1998 | MacKay, Jr. | 473/566 |
| 5,931,750 | A | | 8/1999 | MacKay, Jr. | 473/566 |
| 5,954,602 | A | | 9/1999 | Eggiman et al. | 473/566 |
| 6,022,281 | A | * | 2/2000 | Nolan | 473/457 |
| 6,045,467 | A | | 4/2000 | Anderson | 473/568 |
| 6,053,828 | A | | 4/2000 | Pitsenberger | 473/566 |
| 6,159,115 | A | * | 12/2000 | Hsu | 473/519 |

* cited by examiner

*Primary Examiner*—Mark S. Graham
(74) *Attorney, Agent, or Firm*—Rankin, Hill, Porter & Clark LLP

(57) ABSTRACT

The present invention provides a ball bat including an elongated tubular metal body having a barrel portion at one end and a handle portion at an opposite end. The handle portion terminates a knob that includes a metal collar that extends from the handle portion and a plug that is retained in an opening in the collar. Preferably, the opening in the collar is substantially perpendicular to a longitudinal axis of the elongated tubular metal body and has a diameter that is greater than the diameter of the handle portion. The plug is preferably retained in the opening by means of a snap-fit connection between an edge that defines the opening and a groove in the plug or by means of a bayonet coupling between the plug-and the collar. A portion of the exposed surface of the plug can be used to provide an extended gripping surface.

1 Claim, 5 Drawing Sheets

KNOB FOR A METAL BALL BAT

FIELD OF THE INVENTION

The present invention concerns a metal ball bat and more particularly to a knob for a metal ball bat.

BACKGROUND OF THE INVENTION

Ball bats originally used in the game of baseball were made from wood, typically hickory. These early hickory ball bats were relatively heavy, weighing as much as 42 ounces, and had relatively narrow barrels, which is the hitting portion of the bat. For a variety of reasons, ball bats are generally no longer made from hickory. Modern wood bats are made from Northern white ash, which is strong but less dense than hickory. Modern wood ball bats have a larger barrel yet weigh less than hickory bats.

Despite the advancements in wood ball bat technology over the years, the use of wood ball bats in the games of baseball and softball has declined sharply in recent years. At the present time, wood ball bats are generally used only in professional baseball leagues that have rules requiring their use. Most modern ball bats are constructed of metal.

W. A. Shroyer, Jr. is generally credited with inventing the first all-metal ball bat. See U.S. Pat. No. 1,499,128. Although there were many advancements in metal ball bat technology in the following years, metal ball bats were not widely used until the mid-1970's, when several manufacturers began selling ball bats made of aluminum alloys. These early aluminum ball bats were lighter and stronger than wood ball bats, but had a tendency to dent easily. Modern metal ball bats are manufactured from exotic alloys that are stronger and lighter than the aluminum alloys first used to construct ball bats in the 1970's. Metal ball bats of this type are used in youth baseball leagues to the collegiate ranks, and in both amateur and professional softball leagues.

There have been a number of advancements in metal ball bat technology in recent years. Not surprisingly, most of these advancements have related directly or indirectly to the barrel portion of the bat. For example, Pitsenberger, U.S. Pat. No. 6,053,828, discloses a ball bat having an exterior shell disposed about the barrel portion of the bat. Eggiman, U.S. Pat. No. 5,899,823, discloses a ball bat having a performance enhancing sleeve inserted in the barrel portion of the bat. And, a number of patents disclose a variety of end caps that are inserted into the end of the barrel of the bat to prevent permanent deformation of the end of the barrel of the bat due to contact with a ball. See, e.g., Eggiman et al., U.S. Pat. No. 5,954,602, and MacKay, Jr., U.S. Pat. Nos. 5,421,572, 5,785,614, 5,785,617, and 5,931,750. Despite the recent advancements in metal ball bat technology, there remains substantial room for improvement.

SUMMARY OF THE INVENTION

The present invention concerns a metal ball bat, and more particularly a knob for a metal ball bat. A metal ball bat according to the invention comprises an elongated tubular metal body having a barrel portion at one end and a handle portion at an opposite end. The handle portion terminates a knob that comprises a metal collar that extends from the handle portion and a plug that is retained in an opening in the collar. Preferably, the opening in the collar is substantially perpendicular to a longitudinal axis of the elongated tubular metal body and has a diameter that is greater than the diameter of the handle portion. The plug is preferably retained in the opening by means of a snap-fit connection between an edge that defines the opening in the collar and a groove in the plug. Alternatively, the plug is retained in the opening in the collar by means of a bayonet coupling between the plug and the collar. In one preferred embodiment of the invention, the plug further comprises a stem portion that fits into a cavity in the handle portion when the plug is retained in the opening in the collar. The stem portion can further comprise one or more weights for adjusting the swing characteristics of said ball bat. Preferably, the plug is formed of a polymeric material such as thermoplastic polyurethane elastomer and the collar is formed of formed from an aluminum alloy such as 5052-H32 aluminum alloy. In one preferred embodiment of the invention, the plug has an exposed surface that projects substantially beyond the plane of the opening in the collar to provide an extended gripping surface when the plug is retained in the opening of the collar.

DETAILED DESCRIPTION

Figure 1:
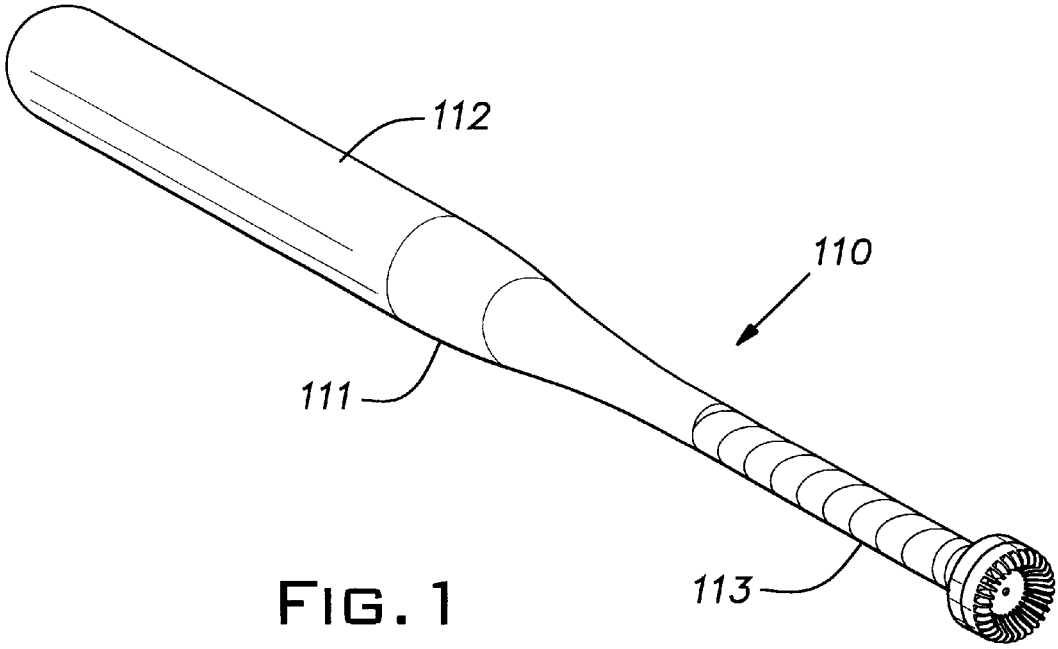
FIG. 1 is a perspective view of one embodiment of a ball bat according to the present invention.
Figure 2:
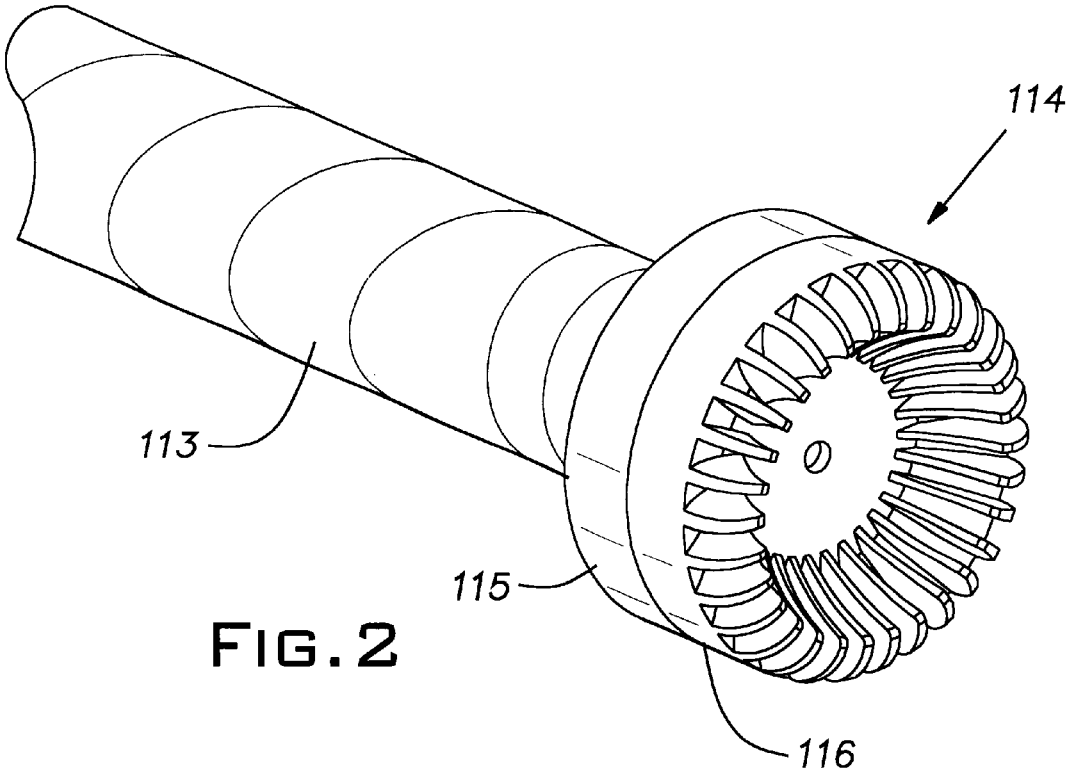
FIG. 2 is a perspective view of a portion of the ball bat shown in FIG. 1.

With reference to FIG. 1, the present invention is directed to a metal ball bat 110 that comprises an elongated tubular metal body 111 having a barrel portion 112 at one end and a handle portion 113 at an opposite end. The handle portion 113 terminates a knob 114. With reference to FIG. 2, the knob 114 comprises a metal collar 115 that extends from the handle portion 113 and a plug 116 that is retained in an opening 117 (not shown in FIG. 2) in the collar 115. Preferably, the collar 115 is formed from an aluminum alloy such as 5052-H32 aluminum alloy and it is welded to the handle portion 113 of the elongated tubular metal body 111.

Figure 4:
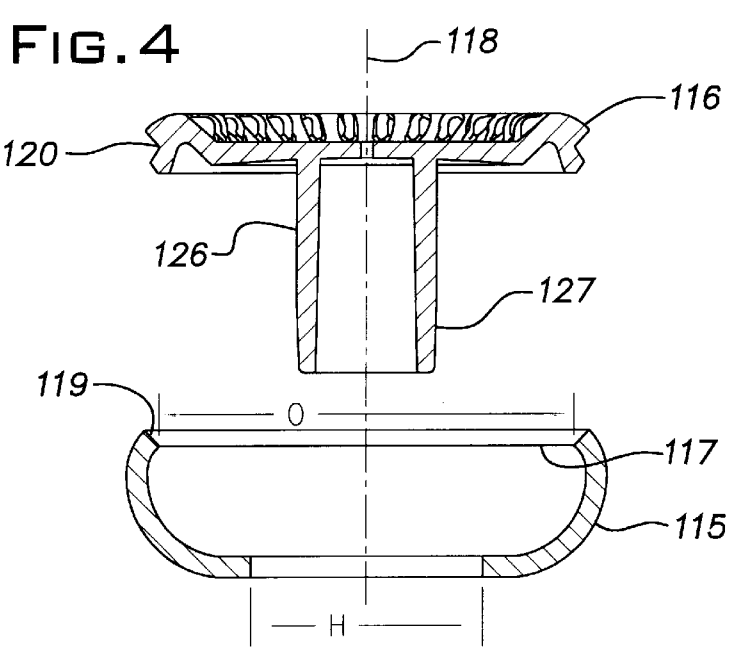
FIG. 4 is an exploded side sectional view of the knob shown in FIG. 3.
Figure 3:
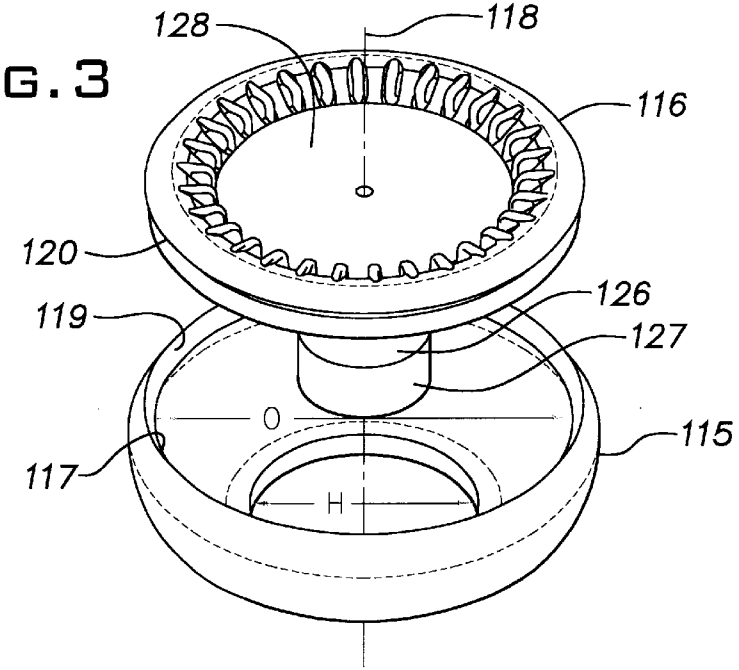
FIG. 3 is an exploded perspective view of one embodiment of the knob of a ball bat according to the present invention.

With reference to FIGS. 3 and 4, the opening 117 in the collar 115 is substantially perpendicular to a longitudinal axis 118 of the elongated tubular metal body 111. Preferably, the diameter O of the opening 117 in the collar 115 is greater than the diameter H of the handle portion 113. However, it will be appreciated that it is not critical that the diameter O of the opening 117 in the collar 115 be greater than the diameter H of the handle portion 113.

Figure 6:
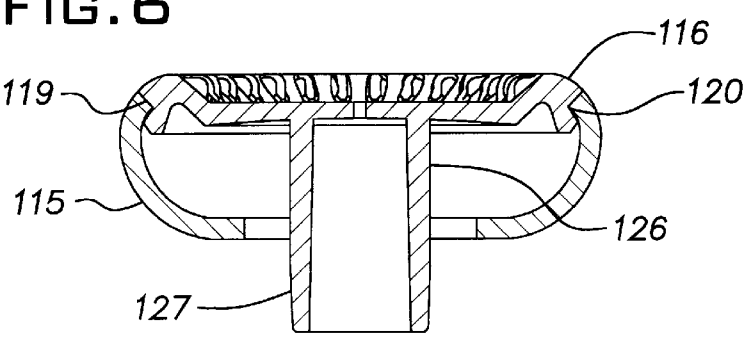
FIG. 6 is a side sectional view of the assembled knob shown in FIG. 3.
Figure 5:
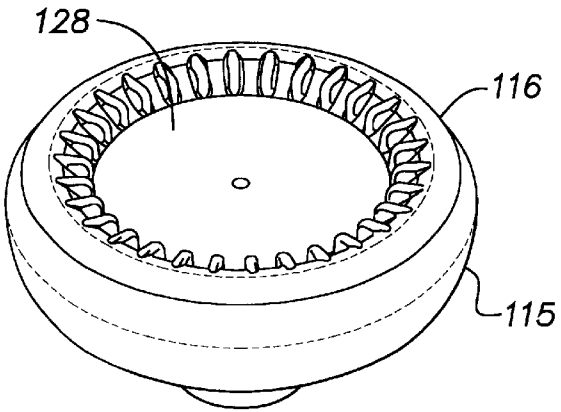
FIG. 5 is a perspective view of the assembled knob shown in FIG. 3.

In one embodiment of the invention, the opening 117 in the collar 115 is defined by an edge 119, and the plug 116 includes a groove 120 for engagement with the edge 119. The plug 116 is thus retained in the opening 117 in the collar 115 by means of a snap-fit engagement between the edge 119 of the opening 117 in the collar 115 and the groove 120 in the plug 116. FIGS. 3 and 5 are perspective views showing one embodiment of a plug 116 according to the present invention being snap-fit into the opening 117 in a collar 115. FIGS. 4 and 6 are sectional side views showing one embodiment of a plug 116 according to the present invention being snap-fit into the opening 117 in a collar 115.

Figure 7:
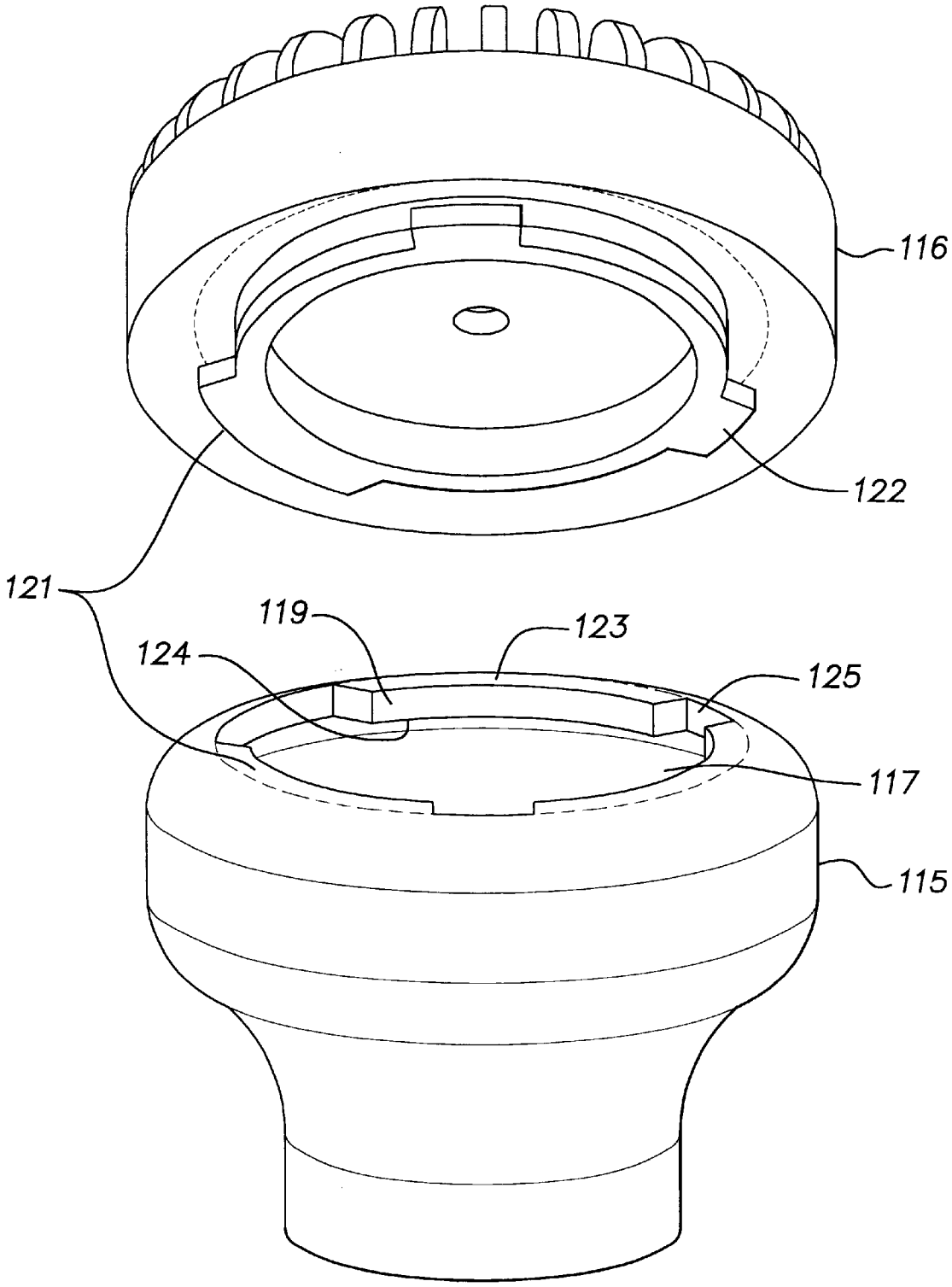
FIG. 7 is an exploded perspective view of another embodiment of the knob of a ball bat according to the present invention.

It will be appreciated that the means of connecting the plug 116 to the collar 115 is not per se critical, and that a number of connectors can be used. In one preferred embodiment of the invention, a bayonet coupling 121 is used to attach the plug 116 to the collar 115. With reference to FIG. 7, the bayonet coupling 121 includes a plurality of tabs 122 extending outwardly around the periphery of that portion of the plug 116 that is adapted to engage with the edge 119 of the collar 115 that defines the opening 117. The edge 119 of collar 115 that defines the opening 117 comprises a radially extending rim 123, and the tabs 122 engage the underside 124 of the rim 123 when the plug 116 is pressed against the collar 115. A plurality of gaps 125 are formed in the rim 123. Each of the gaps 125 corresponds to a tab 122 so as to permit the tabs 122 to pass through the gap 125 when the plug 116 is pressed against the collar 115. The plug 116 is secured to the collar 115 when the plug 116 is rotated relative to the collar 115 so as to cause the tabs 122 to be positioned against the underside 124 of the rim 123. It will be appreciated that the underside 124 of the rim 123 can be provided with stops (not illustrated) to prohibit further rotation of the plug 116 relative to the collar 115.

Preferably, the plug 116 is formed from a polymeric material that provides sufficient resiliency to bias the tabs 122 against the underside 124 of the rim 123. The spring force provided by the inherent resiliency of the polymeric material together with a high coefficient of friction help maintains the tabs 122 in a pressed relationship relative to the underside 124 of the rim 123. The plug 116, however, can be removed from the collar 115 by pushing the plug 116 toward the collar 115 with sufficient force to overcome the spring force and frictional forces between the tabs 122 and the underside 124 of the rim 123 so that each of the tabs 122 can be rotated with respect to the collar 115 to move the tabs 122 into position where they can pass through the gaps 125. The plug 116 is then removed from the collar 115.

In the presently preferred embodiment, the plug 116 is formed from a thermoplastic polyurethane elastomer. One suitable thermoplastic polyurethane elastomer for use in the invention is available as PELLETHANE 2103-55D from the Dow Plastics Business Group of The Dow Chemical Company. It will be appreciated that the plug 116 could be formed from other polymeric materials, including polymeric materials that do not provide resiliency. In such circumstances, it is necessary to use a resilient sealing gasket between the plug 116 and the collar 115 to provide the spring force and friction necessary to keep the tabs 122 of the plug 116 in the proper relationship with the underside 124 of the rim 123.

It will also be appreciated that there are several alternative bayonet coupling configurations that can be used in the invention. For example, the tabs could be disposed around the periphery of the opening in the collar and the rim could be provided in the plug. A variety of bayonet couplings are known, and such couplings can be successfully used in the invention.

In another preferred embodiment of the invention, the handle portion of the elongated tubular metal body defines a cavity. With reference to FIGS. 3 and 4, the plug 116 further comprises a stem portion 126 that fits into the cavity when the plug 116 is retained in the opening 117 of the collar 115. The stem portion 126 can be formed integrally with the rest of the plug 116, or it can further comprise one or more additional components attached to the plug 116. In a preferred embodiment, the stem portion 126 comprises one or more weights 127 for adjusting the swing characteristics of the ball bat 110.

The exposed surface of the plug 116 is not per se critical. In one preferred embodiment illustrated in FIGS. 3 and 5, the plug 116 has an exposed surface 128 that does not project substantially beyond the plane of the opening 117 in the collar 115 when the plug 116 is retained in the opening 117 in the collar 115. In contrast, in the alternative embodiment illustrated in FIG. 8, the plug 116 has an exposed surface 128 that projects substantially beyond the plane of the opening 117 in the collar 115 when the plug 116 is retained in the opening 117 in the collar 115. In this alternative embodiment, a portion 129 of the exposed surface 128 provides an extended gripping surface.

Figure 8:
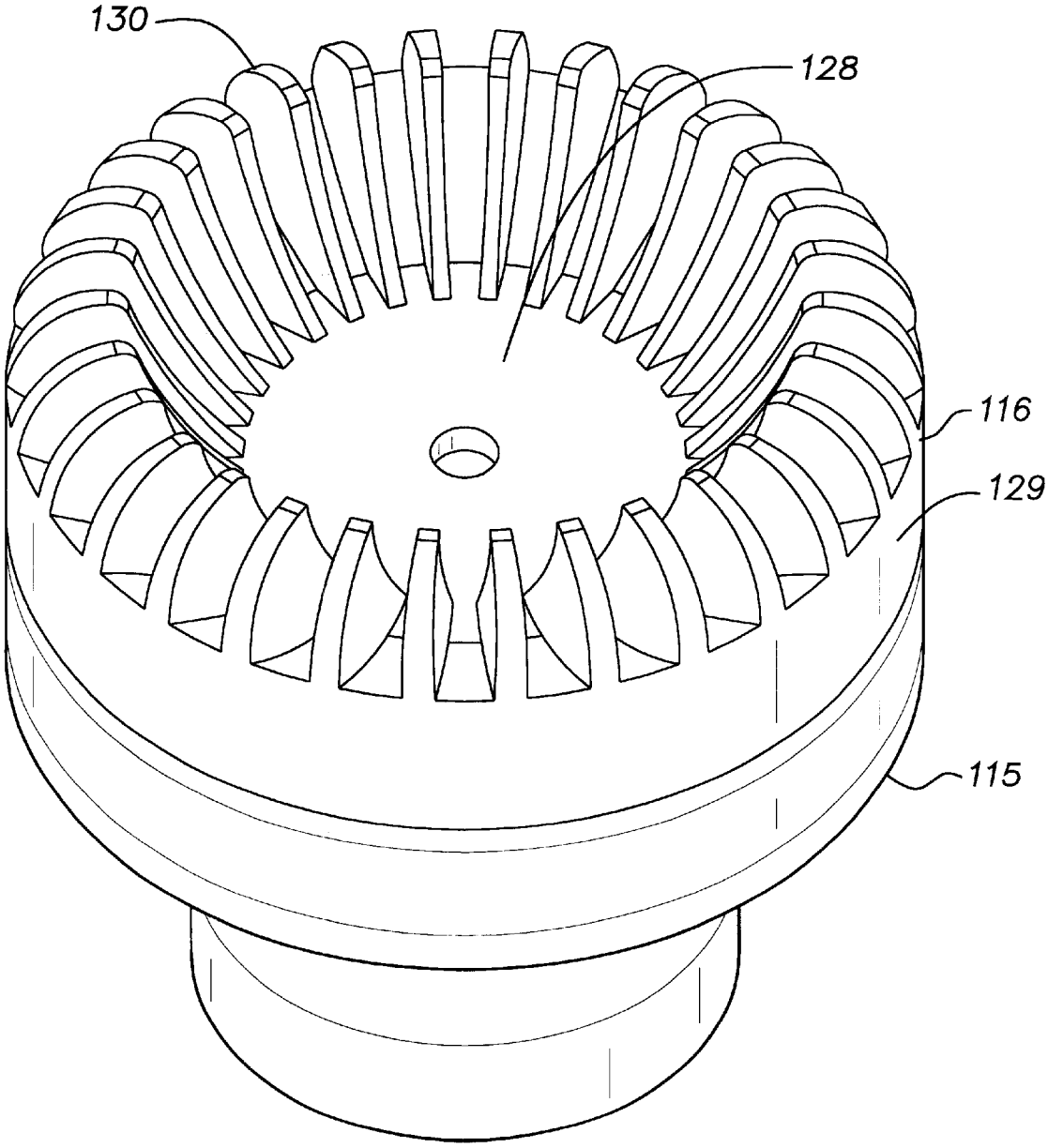
FIG. 8 is a perspective view of the assembled knob shown in FIG. 7.
Figure 9:
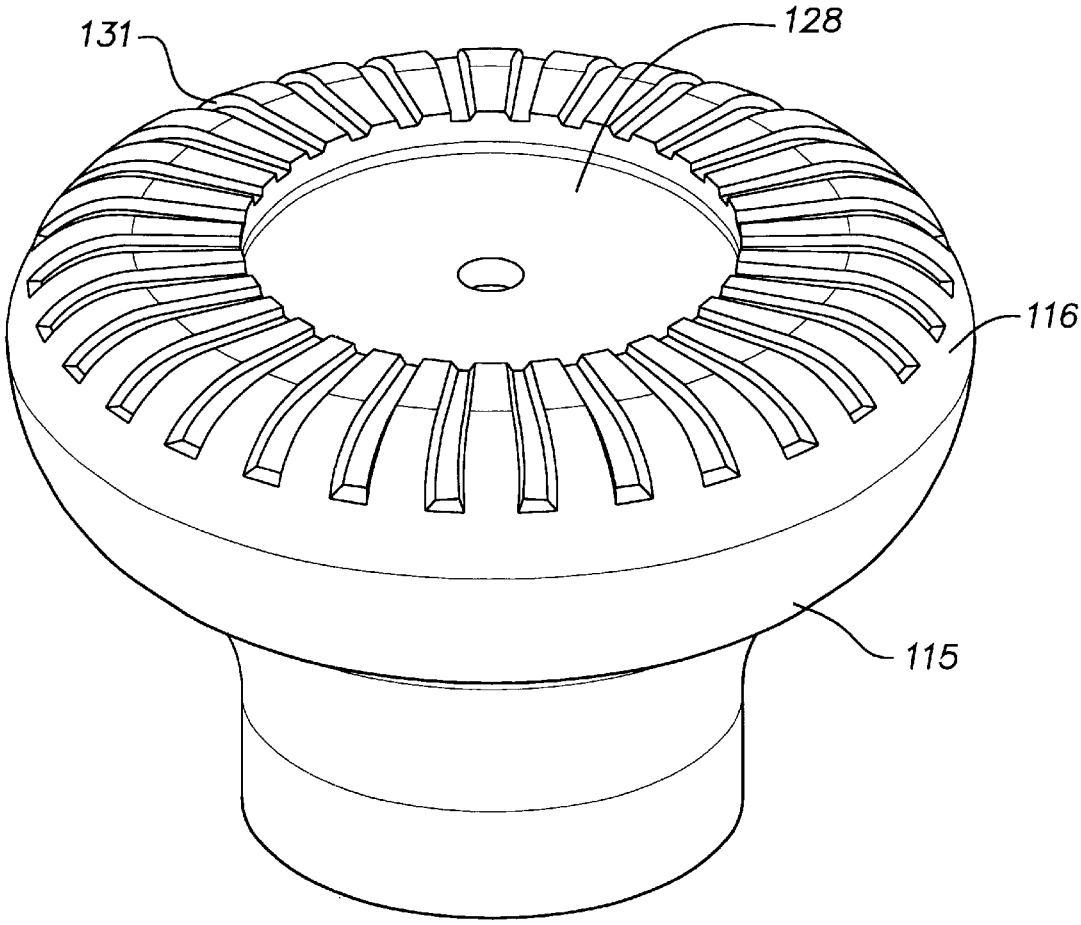
FIG. 9 is a perspective view of another embodiment of an assembled knob of a ball bat according to the present invention.

It will be appreciated that the exposed surface 128 of the plug 116 can be smooth or it can be provided with topographical features. When the exposed surface 128 of the plug 116 is provided with topographical features, a tool having the reverse impression of the topographical features on the exposed surface of the plug 116 can be used to engage such features and thus provide a means for rotating the plug 116 relative to the collar 115 to facilitate the insertion and/or removal of the plug 116 from the opening 117 in the collar 115. For example, as is illustrated in FIGS. 8 and 9, the exposed surface 128 of the plug 116 can be provided with at least one ridge 130 and/or at least one slot 131. A tool (not illustrated) having a pair of projections for engagement with a pair of opposing ridges 130 or slots 131 could then be used to rotate the plug 116 relative to the collar 115 to facilitate the insertion and/or removal of the plug 116 from the opening 117 in the collar 115. It will be appreciated that the tool used to facilitate insertion and/or removal of the plug 116 from the opening 117 in the collar 115 could be multi-functional. For example, the tool could include a bottle opener, a lid lifter, and/or a pick for cleaning debris from cleats or spikes. Furthermore, such tool could be configured such that it could be retained on a key ring.

It will be appreciated that the exposed surface 128 of the plug 116 can be formed with any number of ornamental features and designs to increase the marketability of the ball bat. Ball bats are typically displayed for sale in bat racks that feature a hole that is larger than the diameter of the handle portion of the ball bat, but smaller than the diameter of the knob. The ball bat hangs vertically from the bat rack with only the bottom of the knob being visible to the prospective purchaser. A knob that is highly colored or features unique ornamental designs or other indicia is likely to draw a prospective purchaser's attention more readily than a ball bat having a conventional knob consisting of a metal cap with a paper label adhered thereto.

The ball bat according to the present invention facilitates the manufacture of ball bats. The elongated tubular metal body can be constructed according to conventional means from any of the known ball bat materials presently being used. The collar can be formed integral with the elongated tubular metal body, but more preferably is welded to the handle portion of the body. The plug can then be inserted into the opening in the collar to form the completed ball bat.

A ball bat according to the present invention provides several advantages as compared to prior art ball bats. For example, when the plug is formed of a polymeric material, the polymeric material has a tendency to absorb and thereby dampen shock and/or vibration caused when the barrel portion of the ball bat strikes a ball.

Another advantage provided by the ball bat according to the present invention relates to the extended gripping surface provided when the exposed surface of the plug projects beyond the plane of the opening in the collar when the plug is retained in the opening. Many softball players have been holding prior art softball bats such that one or two of their fingers are actually off the bottom of the knob. The extended gripping surface provided by the exposed surface of the plug according to the present invention permits these softball players to obtain a better and more reliable grip the bat. This cuts down on the number of bats that fly out of player's hands during the game.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed:

1. A ball bat comprising an elongated tubular metal body having a barrel portion at one end and a handle portion at an opposite end, said handle portion terminating in a knob, said knob comprising:

a metal collar welded to said handle portion, said collar defining an opening perpendicular to a longitudinal axis of said elongated tubular metal body; and a plug formed of a polymeric material, said plug being retained in said opening by means of a bayonet coupling between said plug and said collar;

wherein said handle portion defines a hollow cavity and said plug further comprises a stem portion that fits into said cavity when said plug is retained in said opening in said collar; and wherein said plug has an exposed surface that projects substantially beyond the plane of said opening in said collar when said plug is retained in said opening of said collar and wherein a portion of said exposed surface of said plug provides an extended gripping surface.

* * * * *